US005345722A

United States Patent [19]

McKann

[11] Patent Number: 5,345,722

[45] Date of Patent: Sep. 13, 1994

[54] ADJUSTABLE PLASTIC DOOR FRAME

[75] Inventor: H. Smith McKann, Fredericksburg, Va.

[73] Assignee: General Products Company, Inc., Fredericksburg, Va.

[21] Appl. No.: 19,567

[22] Filed: Feb. 18, 1993

Related U.S. Application Data

[63] Continuation-in-part of Ser. No. 858,515, Mar. 27, 1992, Pat. No. 5,187,898.

[51] Int. Cl.[5] ..... E06B 1/04

[52] U.S. Cl. ..... 49/505; 52/212; 52/217

[58] Field of Search ..... 49/505; 52/212, 217

[56] References Cited

U.S. PATENT DOCUMENTS

| | | | |
|---|---|---|---|
| 1,048,988 | 12/1912 | Mayo, Sr. | 52/212 |
| 1,715,579 | 6/1929 | Thye | 52/212 |
| 2,742,117 | 4/1956 | Tolman | 49/505 |
| 2,860,744 | 11/1958 | Mascari | 52/212 |
| 2,893,070 | 7/1959 | Gauthier | 49/505 |
| 3,032,837 | 5/1962 | Ramsey | 49/505 |
| 3,324,599 | 6/1967 | Brost | 49/505 |
| 3,364,624 | 1/1968 | Davis | 49/505 |
| 3,420,003 | 1/1979 | Cline | 52/217 |
| 3,520,085 | 7/1970 | Pond | 49/505 |
| 3,545,135 | 12/1970 | Lieber | 49/505 |
| 3,654,734 | 4/1972 | Lehman | 49/505 |
| 3,788,019 | 1/1974 | Kiselewski | 49/505 |
| 3,800,488 | 4/1974 | Swanson | 52/217 |
| 3,826,050 | 7/1974 | Schwartz | 49/505 |
| 3,881,279 | 5/1975 | Kirton | 49/505 |
| 3,906,671 | 9/1975 | Maldonado | 49/505 |
| 4,395,855 | 8/1983 | Juker | 49/505 |
| 4,467,576 | 8/1984 | Burgers | 49/505 |
| 4,531,337 | 7/1985 | Holdiman | 49/505 X |
| 4,589,229 | 5/1986 | Warren | 49/505 |
| 4,782,630 | 11/1988 | Kleyn | 49/505 |
| 4,787,184 | 11/1988 | Broidon | 52/217 |
| 4,791,758 | 12/1988 | Bauer | 49/505 |
| 4,793,109 | 12/1988 | Noach | 52/211 |
| 4,813,204 | 3/1989 | Rentscheler | 49/505 |
| 4,878,325 | 11/1989 | Van Tuyl | 49/505 |
| 4,912,879 | 4/1990 | Mozuras | 49/505 |
| 4,986,034 | 1/1991 | Mozural et al. | 49/505 |
| 4,986,044 | 1/1991 | Funari | 52/217 |
| 5,070,651 | 12/1991 | Jeter | 49/505 |
| 5,187,898 | 2/1993 | McKann | 49/505 |

FOREIGN PATENT DOCUMENTS

| | | | |
|---|---|---|---|
| 2422180 | 11/1975 | Fed. Rep. of Germany | 49/505 |
| 3900608 | 7/1990 | Fed. Rep. of Germany | 49/505 |

*Primary Examiner*—Philip C. Kannan

*Attorney, Agent, or Firm*—Roylance, Abrams, Berdo & Goodman

[57] ABSTRACT

An adjustable door frame includes a latch jamb, a hinge jamb, two closure jambs, a base header and a closure header, each of which is unitarily formed. The jambs and headers are adjustably connected to accommodate variations in wall thicknesses. Each of the hatch jamb, hinge jamb and base header has a trim section overlying the wall, an inside section extending into the doorway opening, a door abutment section extending perpendicularly into the doorway and a pair of parallel flanges extending perpendicularly from the abutment section and defining a slot. Each of the closure jambs and closure header has a trim section for overlying the opposite wall surface, an inside section extending into the doorway and a tongue section. The slots frictionally engage the tongue sections.

27 Claims, 5 Drawing Sheets

ADJUSTABLE PLASTIC DOOR FRAME

CROSS REFERENCE TO RELATE APPLICATION

This application is a continuation-in-part of U.S patent application Ser. No. 07/858,515 (to be U.S. Pat. No. 5,187,898, issuing Feb. 23, 1993) of H. Smith McKann, filed Mar. 27, 1992, and entitled Adjustable Door Frame, the subject matter of which is incorporated herein by reference.

FIELD OF THE INVENTION

The present invention relates to an adjustable door frame formed of plastic. First and second members form each side jamb assembly and header assembly, with the connection between the respective first and second members of each assembly being adjustable to compensate for varying wall thicknesses.

BACKGROUND OF THE INVENTION

Conventional building industry practice uses prefabricated door frame assemblies which are manufactured at a manufacturing facility and then transported to a remote location for installation. This door frame includes a header assembly for the top of the doorway opening and latch and hinge jamb assemblies for the sides of the doorway opening in the wall.

The thickness of the wall in which the door is to be located often varies. These variations result from variations in the standard materials used as well as in the assembly of those materials in forming the walls. To accommodate these thickness variations in the wall, the frame must be adjustable.

Additionally, the frame should be adaptable to a wide variety of uses, including the addition of a screen or storm door and the addition or omission of exterior and interior trim.

To minimize expenditures in manufacturing, the latch and hinge jamb assemblies and the header assembly should be of generally the same construction.

With the increasing cost of wood, plastic frames, particularly those of vinyl, have become viable for residential use, as well as for commercial use. Thus, the use of plastic door frames is expanding.

SUMMARY OF THE INVENTION

Accordingly, an object of the present invention is to provide an adjustable door frame which can be easily, economically manufactured of plastic.

Another object of the present invention is to provide an adjustable door frame with the same structure for the latch jamb, hinge jamb and header assemblies.

A further object of the present invention is to provide an adjustable door frame which is adaptable to receive a screen or storm door, and can be used with or without exterior trim.

Yet another object of the present invention is to provide an adjustable door frame which is rugged, sturdy, and easy to install.

The foregoing objects are provided by an adjustable door frame comprising first and second members, each of which is unitarily formed. The first member includes a first trim section for overlying a wall surface adjacent the wall doorway opening, a first inside section extending substantially perpendicularly from the first trim section for extending into the doorway opening, a first door abutment section extending substantially perpendicularly from the first inside section at an end thereof remote from the first trim section in a direction parallel to and opposite to the first trim section, and a pair of parallel flanges extending substantially perpendicularly from the first abutment section at its end remote from the first inside section in a direction parallel to and opposite to the first inside section. The flanges define a slot therebetween. The second member includes a second trim section for overlying the opposite side of the wall, a second inside section extending substantially perpendicularly from the second trim section for extending into the doorway opening toward and adjacent to the first inside section, and a tongue section extending from the second inside section at its end remote from the second trim section as a coplanar extension thereof. The slot receives and frictionally engages the tongue section.

By forming the frame in this matter, the engagement of the tongue section in the slot provides an adjustable connection of the first and second members. This adjustable connection will compensate for varying wall thicknesses, while providing a structure which is sturdy, simple to install and manufacture, inexpensive to manufacture, and is highly adaptable to varied uses.

Other objects, advantages, and salient features of the present invention will become apparent from the following detailed description, which, taken into conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
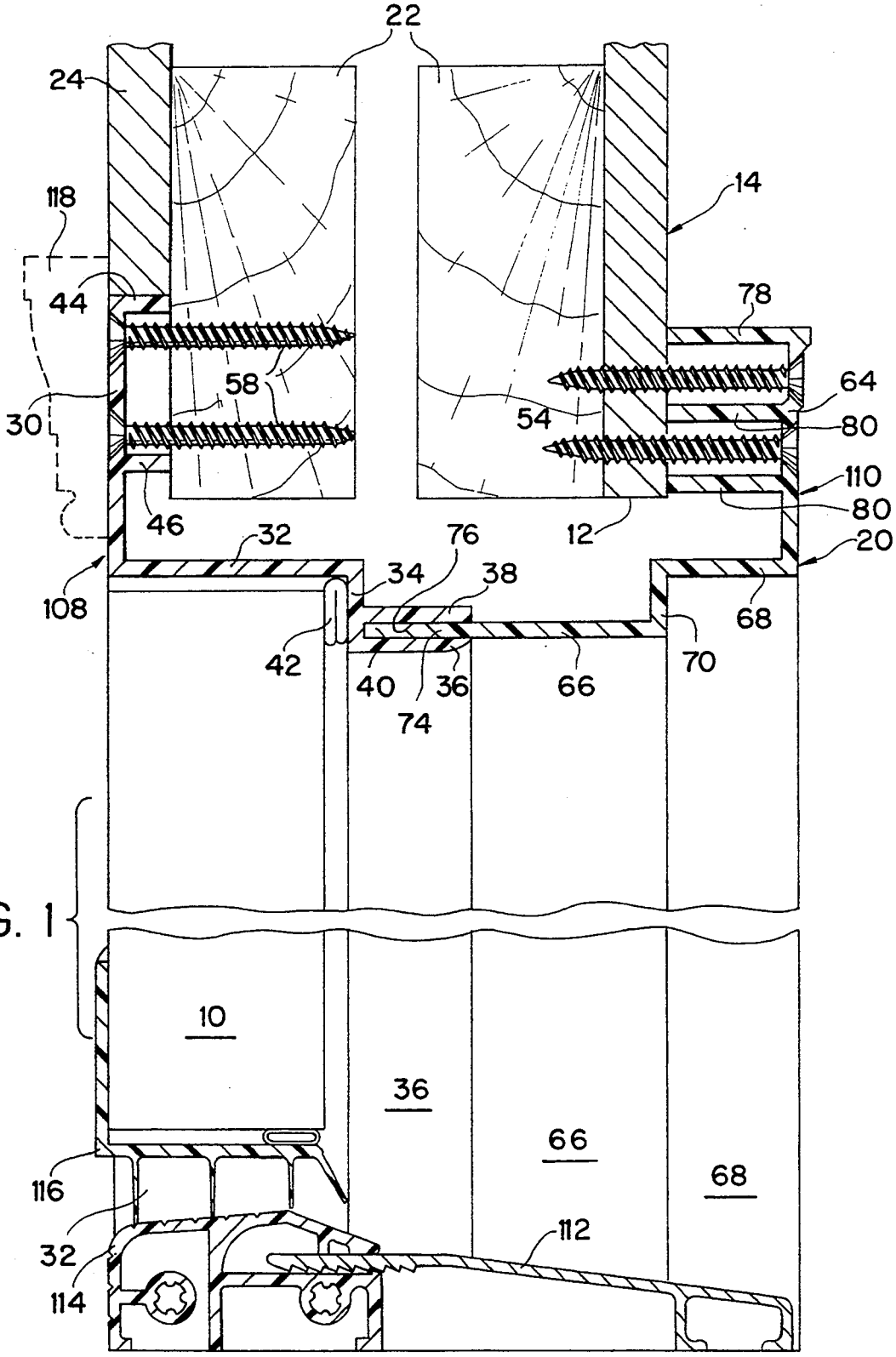
FIG. 1 is a partial, side elevational view in section of adjustable door frame according to a first embodiment of the present invention.
Figure 2:
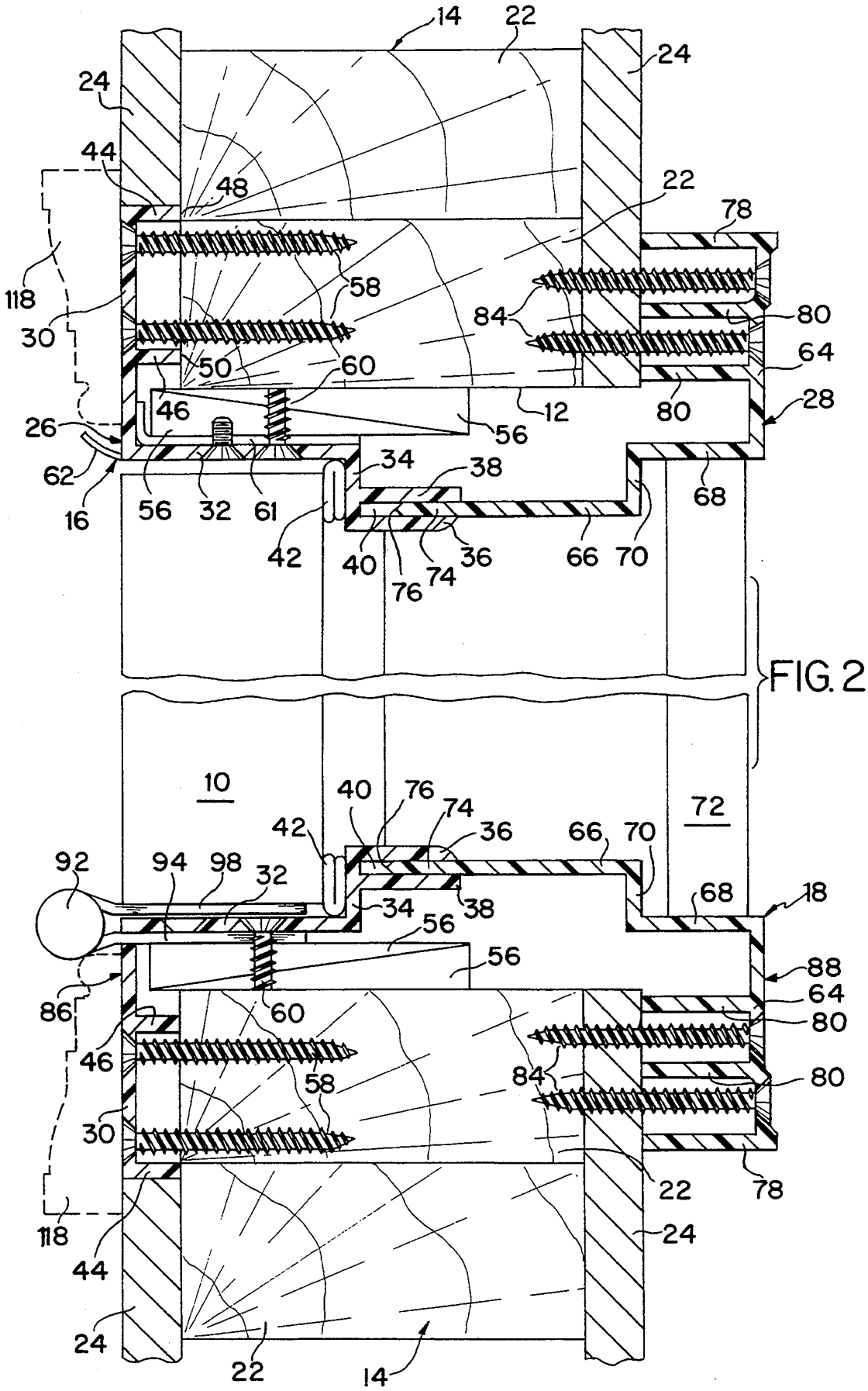
FIG. 2 is a partial, top plan view in section of a door frame according to the first embodiment of the present invention.

Referring initially to FIGS. 1 and 2, the adjustable door frame of the first embodiment of the present invention pivotally mounts a door 10 in a doorway 12 in a wall 14. The door frame includes a latch jamb assembly 16, a hinge jamb assembly 18, and a header assembly 20. Each of these three assemblies is formed of two mating members. The cross-sectional shapes of the two members in each assembly are essentially identical.

The wall 14 having the doorway 12 can be of any conventional form. For example, the wall can include wood studs 22 on which dry wall panels 24 are mounted. The dimensional variations in the studs and dry wall panels, as well as the assembly thereof, produce the variations in the thickness of the entire wall, that is, between the oppositely directed surfaces of the dry wall panels 24.

As illustrated in FIG. 2, latch jamb assembly 16 comprises a latch jamb 26 and a closure jamb 28. Latch jamb 26 and closure jamb 28 form the two members which are adjustable relative to each other to accommodate for the different wall thicknesses and are secured to the wall. Each of the latch jamb and closure jamb is unitarily formed from a single piece of extruded plastic, particularly vinyl.

Latch jamb 26 comprises a trim section 30 which is planar and overlies a wall surface adjacent doorway 12 in wall 14. An inside section 32 extends substantially perpendicularly from trim section 30 and into the doorway. The inside section is also essentially planar. The inside section terminates at a door abutment section 34. Door abutment section 34 extends perpendicularly from the inside section at its end remote from trim section 30. The door abutment section extends in a direction parallel to and opposite to trim section 30, i.e., towards the center of the doorway and towards hinge jamb assembly 18. The surface of abutment section 34 facing door 10 is uninterrupted and planar. A pair of parallel, spaced, generally planar flanges 36 and 38 and extend substantially perpendicularly from door abutment section 34 at its end remote from inside section 32. The flanges extend in a direction parallel to and opposite to the inside section, i.e., towards closure jamb 28, and define a slot 40 therebetween.

A door seal or weatherseal 42 is mounted on the planar surface of abutment section 34 facing door 10.

Trim section 30 terminates at its end remote from inside section 32 in a planar lip 44. Lip 44 extends substantially perpendicularly from trim section 30, and is parallel to and extends in the same direction as inside section 32. A second planar lip 46 extends perpendicularly from trim section 30 between lip 44 and inside section 32, and extends in the same direction as inside section 32. Lips 44 and 46 have coplanar free end surfaces 48 and 50, respectively.

Latch jamb 26 is mounted to wall 14 with spacer wedges 56 located under inside section 32. Screws 58 and 60 extend through countersunk holes in trim section 30 and inside section 32, respectively, and into wall 14 to secure latch jamb 26 in place on the wall. A suitable latch mechanism (not illustrated) can be mounted on inside section 32 to mate with a locking and latching mechanism conventionally used on doors. The latch jamb can be reinforced in the area of the latch mechanism by a metal reinforcement plate 61 secured by screws to inside section 32 opposite strike plate 62.

Closure jamb 28 has a planar trim section 64 overlying a wall surface adjacent a side of doorway 12 opposite from trim section 30. An inside section 66 extends substantially perpendicularly from trim section 64 for extending into the doorway toward and adjacent to inside section 32 of latch jamb 26. Inside section 66 is joined to trim section 64 by two parts 68 and 70, which together define a door abutment section. Part 68 extends directly from trim section 64 and is substantially perpendicular thereto. Part 70 extends perpendicularly from part 68 at an end thereof remote from trim section 64, and is joined directly to and is perpendicular to inside section 66. The door abutment section defined by parts 68 and 70 provides a recess for accommodating a screen or storm door 72.

Inside section 66 terminates at its end remote from part 70 in a tongue section 74 with a tapered lip 76. Tongue section 74 is a coplanar extension of inside section 66, is received with slot 40 and frictionally engages flanges 36 and 38.

A planar end lip 78 extends perpendicularly from trim section 64 from its end remote from part 68. The lip extends in the same direction as part 68 and inside section 66, and extends toward wall 14. Planar inside lips 80 extend perpendicularly trim section 64 between lip 78 and part 68 and parallel to and spaced from each other, and extend in the same direction as lip 78. Lips 78 and 80 have coplanar free end surfaces.

To retain closure jamb 28 in place, screws 84 extend through countersunk holes in trim section 64 and into the wall 14, as illustrated.

Hinge jamb assembly 18 comprises a hinge jamb 86 and a closure jamb 88, each of which like latch jamb 26 and closure jamb 28 are unitarily formed from single pieces of extruded plastic, particularly vinyl. Hinge jamb 86 is constructed with a cross-sectional configuration which is substantially identical to latch jamb 26, except for the preparation for supporting the hinges. Like latch jamb 26, hinge jamb 86 has lips 44 and 46, a trim section 30, an inside section 32, a door abutment section 34 and flanges 36 and 38 defining a slot 40. The hinge jamb is mounted on wall 14, and is secured by screws 58 and 60 and spacer wedges 56.

At appropriate locations along the length of hinge jamb 86, inside section 32 has holes for screws to attach each hinge 92. Hinge 92 comprises a wall plate 94 coupled to the hinge Jamb and a door plate 98 is secured to the hinged edge of door 10 by screws.

A compression weatherseal 42 is mounted on and attached to door abutment section 34 of hinge jamb 86.

Closure jamb 88 is identical to closure jamb 28, and includes lips 78 and 80, a trim section 64, parts 68 and 70, inside section 66, tongue section 74 and tapered tip 76. Slot 40 of hinge jamb 86 receives and frictionally engages tongue section 74. Closure jamb 88 is secured to the wall by screws 84.

Header assembly 20 comprises a base header 108 and a closure header 110. The base header and the closure header are unitarily formed from single pieces of extruded plastic, particularly vinyl, in the same manner as the previously described latch jamb 26 and closure jamb 28, respectively.

The cross-sectional configuration of base header 108 is essentially identical to that of latch jamb 26. Specifically, base header 108 includes lips 44 and 46, a trim section 30, an inside section 32, a door abutment section 34 and flanges 36 and 38 defining a slot 40. A weatherseal 42 is supported on the door abutment section. Base header 108 is secured to wall 14 by screws 58.

Closure header 110 is essentially identical in cross-sectional configuration to closure jambs 28 and 88. Specifically, closure header 110 includes lips 78 and 80, a trim section 64, secondary door abutment parts 68 and 70, inside section 66 and a tongue section 78 with a tapered tip 76. The tongue section is received in slot 40 of base header 108. The closure header is secured to the wall by screws 84.

Each of latch jamb 26, hinge jamb 86, closure jambs 28 and 88, base header 108 and closure header 110 are separately formed in a suitable manufacturing facility. The base header can be attached in a conventional manner to the latch and hinge jambs at the installation site or the manufacturing facility. Similarly, the closure header can be attached in a conventional manner to the closure jambs at the installation site or the manufacturing facility. Once the base header-closure jamb assembly and the closure header-closure jamb assembly are assembled, the two assemblies are connected adjustably by the engagement of the tongue sections 74 in slots 40. The adjustment provided by the engagement of the tongue sections and slots will accommodate variations in the wall thickness. The mounting screws can then be installed to mount and secure the adjustable door frame to wall 14 in the doorway.

The lower ends of the hinge and latch jambs and the closure jambs can be attached to a threshold assembly extending across the floor of the doorway. A typical threshold assembly is illustrated in FIG. 1, and comprises an aluminum extender threshold 112 and a vinyl base threshold 114. The base threshold 114 engages and mates with a sweep 116 suitably mounted on the door to provide a seal at the lower edge of the door. Such threshold assembly is typically used on an outside entrance door.

An inside surface of a doorway can be decorated with moldings 118 mounted over trim sections 30.

Figure 3:
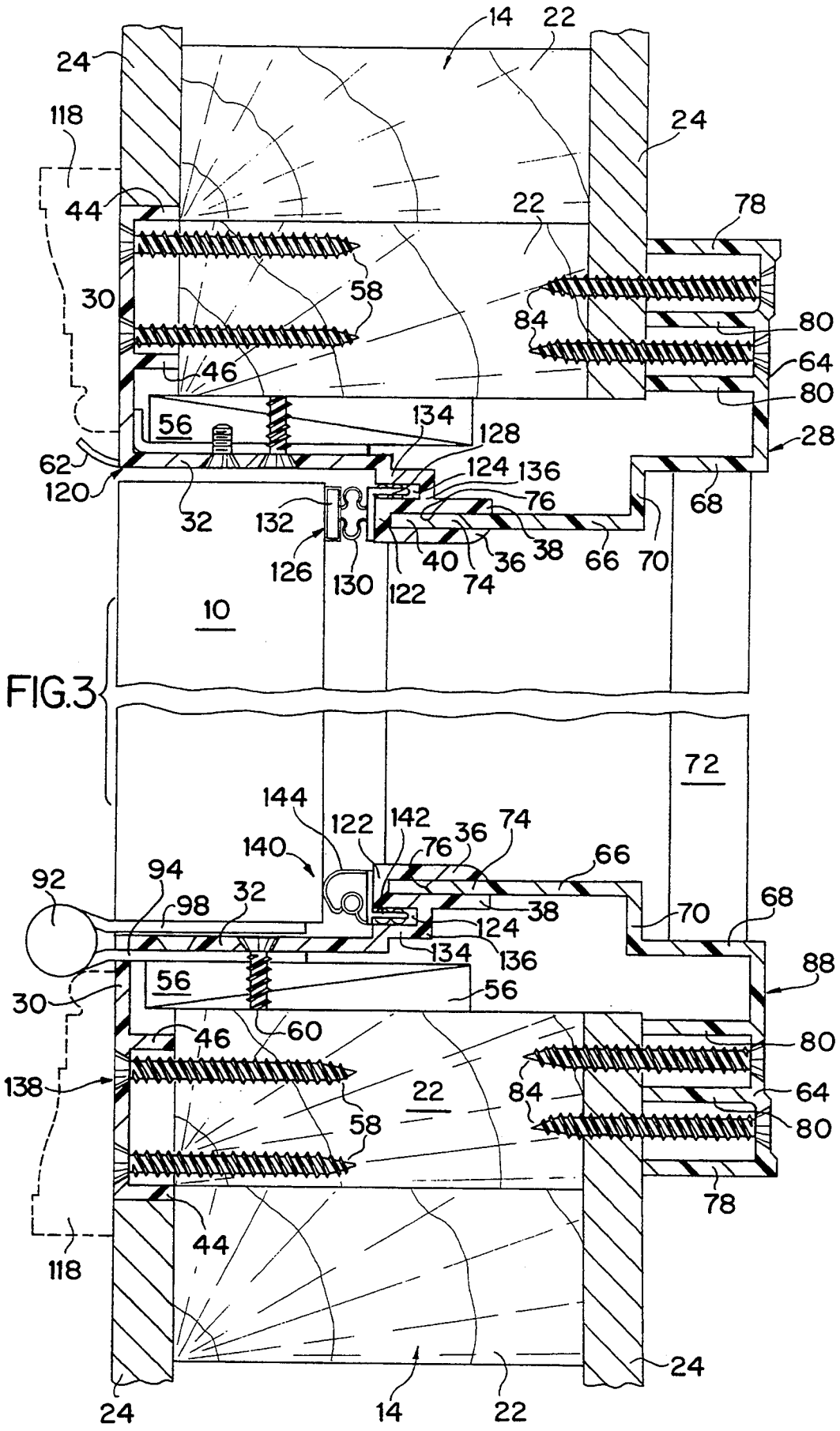
FIG. 3 is a partial, top plan view in section of a door frame according to a second embodiment of the present invention.

Referring now to FIG. 3, a second embodiment of the present invention comprises a modified latch jamb 120. The closure jambs 28 and 88 are identical to those of the first embodiment, and thus are not described in detail. Features of the second embodiment that are similar to those of the first embodiment are identified with like reference numbers.

Latch jamb 120 differs from latch jamb 128 in the configuration of the abutment section. Abutment section 122 of latch jamb 120 has a groove 124 adjacent the juncture of inside section 32 and abutment section 122. Groove 124 retains a door seal or weather seal 126.

Weather seal 126 includes a stem 128 located and retained in groove 124, a compressible part 130 attached to this stem and extending outside of the groove, and a magnetic part 132 attached to the compressible part. The magnetic part overlies abutment section 122 for engaging the adjacent door edge and providing a seal therebetween.

Groove 124 is defined by portions 134 and 136, as well as a section of flange 38. Portion 134 is generally parallel and is spaced from flange 138 and inside section 32. Portion 136 joins portion 134 to flange 38 intermediate the opposite ends of flange 38.

Hinge Jamb 138 of FIG. 3 is modified to provide a groove 124 in abutment section 122. The groove is defined by portions 134 and 136, as well as flange 38.

A compression seal 140 is mounted on abutment section 122 of latch jamb 138. The compression weatherseal 140 includes a stem 142 secured in hinge jamb groove 124 and a compression part 144 overlying and engaging hinge jamb abutment section 122 and the adjacent surface of door 10.

Figure 4:
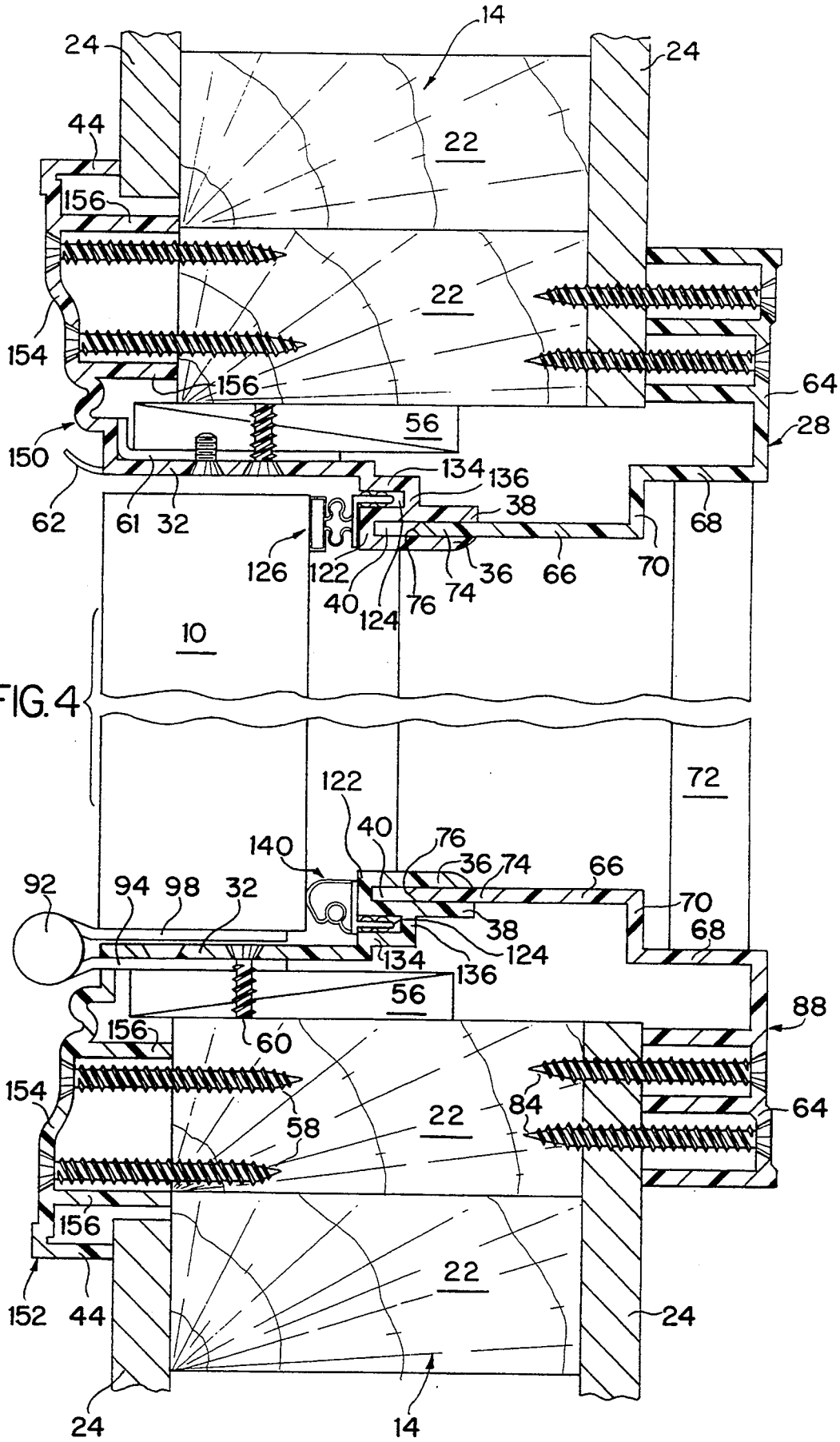
FIG. 4 is a partial, top plan view in section of a door frame according to a third embodiment of the present invention.

FIG. 4 illustrates a modification of the embodiment of FIG. 3. In FIG. 4, latch jamb 150 and hinge jamb 152 are modified from the latch and hinge jambs of FIG. 3 in the form of the trim sections. The remaining features of the door assembly illustrated in FIG. 4 are similar to features of the previous embodiments, and are identified with like reference numbers.

The trim sections 154 of latch jamb 150 and hinge jamb 152 do not have planar outer surfaces that can be arranged coplanar with the outer surfaces of dry wall panels 124, as illustrated in FIGS. 1–3. Rather, trim sections 154 are profiled to take the shape of a decorative molding, thereby eliminating the need for molding 118 as in FIGS. 1–3. Additionally, two lips 156 are provided intermediate end lip 44 and inside section 32. Closure jambs 28 and 88 are again identical to the first embodiment, and thus, are not described in detail.

The header is for use with the second and third embodiments is modified as shown for the hinge and latch jambs of FIGS. 3 and 4.

Figure 5:
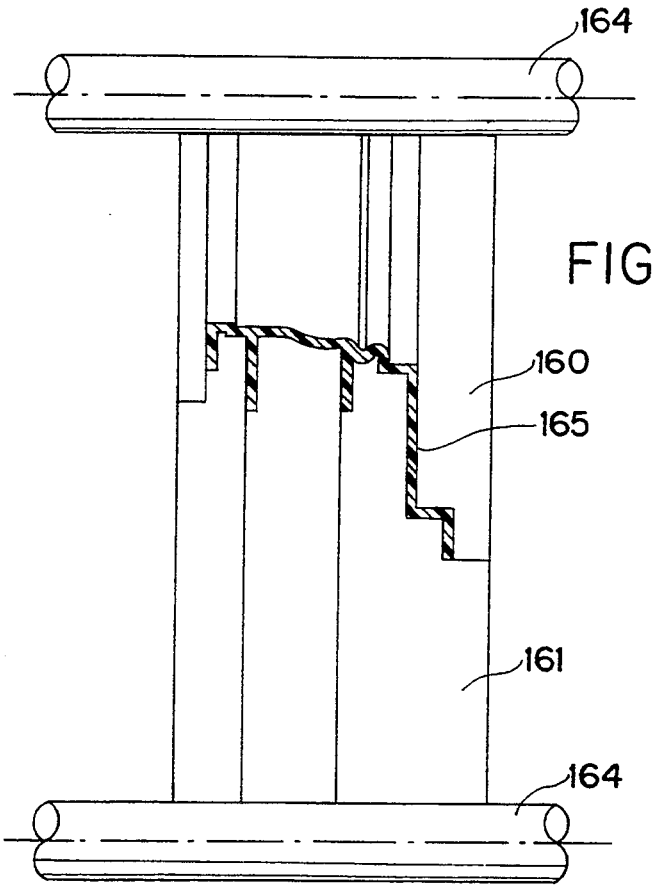
FIGS. 5 and 6 are side elevational views of cooling roller systems for forming the door frame assembly members according to the present invention.
Figure 6:
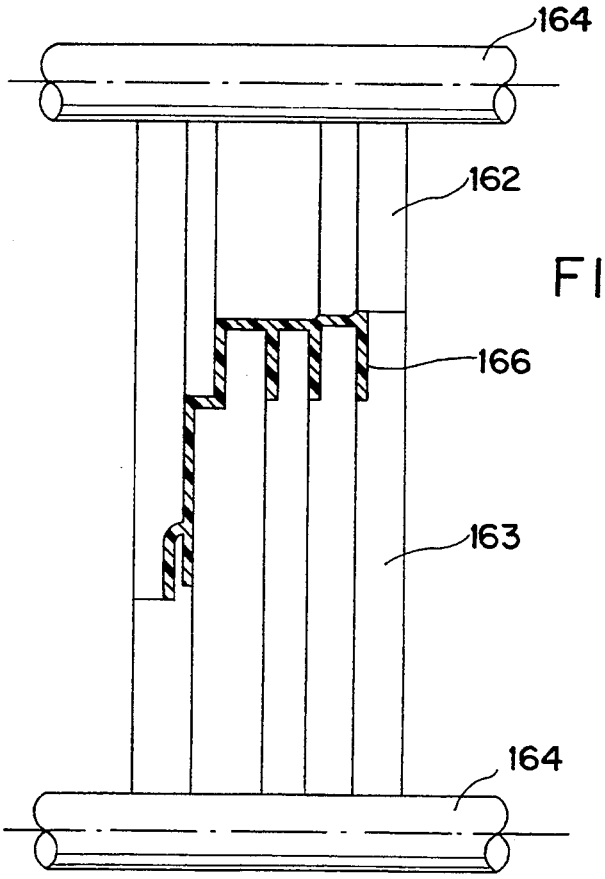

The profiles for the plastic extrusions used to form latch jambs, hinge jambs, base headers, closure jambs and closure headers for frame assemblies according to the present invention facilitate formation by plastic extrusion and then contact of the extrusions by a set of cooling rolls, immediately downstream of the plastic extrusion head. Representative cooling rolls are illustrated in FIGS. 4 and 5. The cooling rolls 160, 161, 162 and 163 are each rotatably mounted by the respective shaft 164. The adjacent faces of the rolls are suitably profiled to conform to the extruded plastic frame member 165 or 166.

The cooling rollers simultaneously establish and retain the extruded shape, while cooling the extrusion during passage between the rolls. Cooling liquid or gas can be passed through the cooling rolls to enhance the cooling operation.

The use of cooling rolls enables the extrusion process to operate at a significantly higher speed. The use of the cooling rolls to enhance manufacture is facilitated by the present invention by the use of such features as inwardly extending flanges and the lack of any under cut portions in the frame members.

Without the use of cooling rolls the speed of extrusion must be significantly decreased. When the material is shaped, it is still flexible and incapable of retaining its shape until it is adequately cooled. Thus, extrusion process must be operated slowly to allow the extruded material to cool adequately and retain its shape before it is moved too far from the extrusion head. With the use of the cooling rolls, the cooling rolls simultaneously establish and retain the extrusion shape and cool it such that the extrusion speed can be much higher. Multiple sets of cooling rolls can be used to permit an even higher extrusion speed.

While particular embodiments have been chosen to illustrate the invention, it will be understood by those skilled in the art that various changes and modifications can be made therein without departing from the scope of the invention as defined in the appended claims.

What is claimed is:

1. An adjustable door frame, comprising:

a first member unitarily formed without any undercut portions, said first member including a first trim section for overlying a wall surface adjacent a doorway opening in a wall, a substantially planar first inside section extending substantially perpendicularly in a single plane from said first trim section for extending into the doorway opening, a first door abutment section extending substantially perpendicularly from said first inside section at an end thereof remote from said first trim section in a direction parallel to and opposite to said first trim section, and a pair of parallel, substantially planar flanges extending substantially perpendicularly from said first abutment section at an end thereof remote from said first inside section in a direction parallel to and opposite to said first inside section, said flanges defining a slot therebetween having a constant width along an entire length said first abutment section to free ends of said flanges; and a second member unitarily formed without said second member including a second trim section for overlying a wall surface adjacent an opposite side of the doorway opening in the wall, a substantially planar second inside section extending substantially perpendicularly from said second trim section in a single plane for extending into the doorway opening toward and adjacent to said first inside section, and a tongue section extending from said second inside section in a single plane at an end thereof remote from said second trim section as a coplanar extension thereof along an entire length of said tongue section, said slot receiving and frictionally engaging said tongue section;

whereby engagement of said tongue section in said slot provides an adjustable connection of said first and second members to compensate for varying wall thickness, and said first and second members can be engaged by sets of cooling rolls after being formed in extrusion heads.

2. An adjustable door frames according to claim 1 wherein said first and second members are formed of extruded plastic.

3. An adjustable door frame according to claim 2 wherein said plastic is vinyl.

4. An adjustable door frame according to claim 1 wherein said first door abutment section comprises a groove adjacent said first inside section; and seal means, for engaging a door mounted by said first and second members, is secured in said groove.

5. An adjustable door frame according to claim 4 wherein said groove is defined by first, second and third portions of said first door abutment section, said first and third portions being generally parallel to each other and said first inside section and perpendicular to said second portion.

6. An adjustable door frame according to claim 4 wherein said seal means comprises an attachment stem secured in said groove and a compressible part overlying said first door abutment section.

7. An adjustable door frame according to claim 1 wherein said first door abutment section is a solid, planar member with an uninterrupted planar surface.

8. An adjustable door frame according to claim 7 wherein seal means, for engaging a door mounted by said first and second members, is mounted on said planar surface.

9. An adjustable door frame according to claim 1 wherein each of said trim sections terminates, at an end thereof remote from the respective inside section, in a planar lip extending in a single plane substantially perpendicularly from the respective trim section to a free end of said lip and parallel to and in the same direction as the respective inside section.

10. An adjustable door frame according to claim 1 wherein each of said trim sections have lips extending substantially perpendicularly therefrom and parallel to and in the same direction as the respective inside section.

11. An adjustable door frame according to claim 10 wherein said lips are flat, planar members.

12. An adjustable door frame according to claim 1 wherein said second member comprises a second door abutment section between said second trim section and said second inside section.

13. An adjustable door frame according to claim 12 wherein said second door abutment section comprises a first part extending perpendicularly from said second trim section and a second part extending perpendicularly from said first part at an edge thereof remote from said second trim section.

14. An adjustable door frame according to claim 1 wherein a metal reinforcing plate is mounted on an outside surface of said first inside section in a latch plate preparation area thereof.

15. An adjustable door frame, comprising:

a first frame assembly having a latch jamb, a hinge jamb and base header each being unitarily formed without any undercut portions and including a first trim section for overlying a wall surface adjacent doorway opening in a wall, a substantially planar first inside section extending substantially perpendicularly in a single plane from said first trim section for extending into the doorway opening, a first door abutment section extending substantially perpendicularly from said first inside section at an end thereof remote from said first trim section in a direction parallel to and opposite to said first trim section, and a pair of substantially planar flanges extending substantially perpendicularly from said first abutment section at an end thereof remote from said first inside section in a direction parallel to and opposite to said first inside section, said flanges defining a slot therebetween having a constant width along an entire length thereof from said end of said first abutment section to free ends of said flange; and a second frame assembly having two closure jambs and a closure header each being unitarily formed without any undercut portions and each including a second trim section for overlying a wall surface adjacent an opposite side of the doorway opening in the wall, a substantially planar second inside section extending substantially perpendicularly form said second trim section in a single plane for extending into the doorway opening toward and adjacent to the respective inside section, and a tongue section extending from said second inside section in a single plane at an end thereof remote from said second trim section and as a coplanar extension thereof along an entire length of said tongue section, said slot receiving and frictionally engaging the respective tongue section;

whereby engagement of said tongue sections in said slots provides an adjustable connection of said first and second frame assemblies to compensate for varying wall thickness, and said headers and jambs can be engaged by sets of cooling rolls after being formed in extrusion heads.

16. An adjustable door frames according to claim 15 wherein said first and second members are formed of extruded plastic.

17. An adjustable door frame according to claim 16 wherein said plastic is vinyl.

18. An adjustable door frame according to claim 15 wherein said first door abutment sections comprise grooves adjacent said first inside sections; and seal means, for engaging a door mounted by said first and second frame assemblies, are secured in said grooves.

19. An adjustable door frame according to claim 18 wherein each said groove is defined by first, second and third portions of the respective first door abutment section, said first and third portions of each said groove being generally parallel to each other and the respective first inside section and perpendicular to the respective second portion.

20. An adjustable door frame according to claim 18 wherein said seal means comprises attachment stems secured in said grooves and compressible parts overlying said first door abutment sections.

21. An adjustable door frame according to claim 15 wherein said first door abutment sections are planar solid members with uninterrupted planar surfaces.

22. An adjustable door frame according to claim 21 wherein seal means, for engaging a door mounted by said first and second door frame assemblies, are mounted on said planar surfaces.

23. An adjustable door frame according to claim 15 wherein each of said trim sections terminates, at an end thereof remote from the respective inside section, in a planar lip extending in a single plane substantially perpendicularly from the respective trim section to a free end of said lip and parallel to and in the same direction as the respective inside section.

24. An adjustable door frame according to claim 15 wherein each of said trim sections have lips extending substantially perpendicularly therefrom and parallel to and in the same direction as the respective inside section.

25. An adjustable door frame according to claim 24 wherein said lips are flat, planar members.

26. An adjustable door frame according to claim 15 wherein each of said closure jambs and said closure header of said second frame assembly comprises a second door abutment section between said second trim section and said second inside section thereof.

27. An adjustable door frame according to claim 26 wherein each said second door abutment section comprises a first part extending perpendicularly from the respective second trim section and a second part extending perpendicularly from said first part at an edge thereof remote from the respective second trim section.

* * * * *